US009735519B2

(12) United States Patent
Yi et al.

(10) Patent No.: US 9,735,519 B2
(45) Date of Patent: Aug. 15, 2017

(54) COAXIAL CONNECTOR ASSEMBLY AND COMMUNICATION SYSTEM HAVING A PLURALITY OF COAXIAL CONTACTS

(71) Applicant: TYCO ELECTRONICS CORPORATION, Berwyn, PA (US)

(72) Inventors: Chong Hun Yi, Mechanicsburg, PA (US); Stephen Thomas Morley, Manheim, PA (US); Keith Edwin Miller, Manheim, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/966,376

(22) Filed: Dec. 11, 2015

(65) Prior Publication Data

US 2017/0170611 A1 Jun. 15, 2017

(51) Int. Cl.
*H01R 13/64* (2006.01)
*H01R 24/38* (2011.01)
(Continued)

(52) U.S. Cl.
CPC ..... *H01R 24/38* (2013.01); *H01R 13/6315* (2013.01); *H01R 2107/00* (2013.01); *Y10S 439/942* (2013.01)

(58) Field of Classification Search
CPC .... H01R 12/91; H01R 13/6315; H01R 24/38; H01R 217/00; H01R 2107/00; Y10S 439/942
(Continued)

(56) References Cited

U.S. PATENT DOCUMENTS 3,094,364 A * 6/1963 Liagg ..... H01R 13/629 285/154.1
4,697,859 A * 10/1987 Fisher, Jr. ..... H01R 13/6315 439/246
(Continued)

FOREIGN PATENT DOCUMENTS

JP H07 272810 A 10/1995

OTHER PUBLICATIONS

Steve Morley; Multi-Contact Coax Connectors and Vita Standards; Aerospace, Defense & Marine—White Paper; 2012; 6 Pages.
(Continued)

*Primary Examiner* — Tulsidas C Patel
*Assistant Examiner* — Travis Chambers

(57) ABSTRACT

Coaxial connector assembly includes a connector module having a connector body and a plurality of coaxial contacts. The coaxial connector assembly also includes a mounting frame having a mating side and a mounting side that face in opposite directions. The mounting side faces in a mounting direction along the mating axis and is configured to interface with a support wall. The mounting frame defines a passage that extends through the mating and mounting sides. The passage includes a connector-receiving recess that opens to the mounting side and is defined by blocking surfaces. The blocking surfaces include a first blocking surface that faces in a lateral direction that is perpendicular to the mating axis and a second blocking surface that faces in the mounting direction. The first and second blocking surfaces are sized and shaped relative to the connector module to permit the connector module to float.

20 Claims, 5 Drawing Sheets

(51) Int. Cl.
*H01R 13/631* (2006.01)
*H01R 107/00* (2006.01)

(58) Field of Classification Search
USPC ..... 439/579, 246, 247, 942, 248
See application file for complete search history.

(56) References Cited

U.S. PATENT DOCUMENTS 4,909,748 A * 3/1990 Kozono ..... H01R 13/6315 439/247
5,752,845 A * 5/1998 Fu ..... B60N 2/0224 439/247
5,944,548 A 8/1999 Saito
7,252,525 B2 * 8/2007 Ide ..... H01R 13/506 439/247
7,416,415 B2 * 8/2008 Hart ..... H01R 24/52 439/579
7,704,077 B1 4/2010 Morley
7,798,834 B2 * 9/2010 Wu ..... H01R 13/745 439/247
7,887,335 B2 2/2011 Morley
8,029,324 B1 * 10/2011 Yi ..... H01R 13/518 439/745
8,360,806 B2 * 1/2013 Yi ..... H01R 24/52 439/579
8,360,807 B2 * 1/2013 Buff ..... H01R 13/6315 439/581
8,672,708 B2 * 3/2014 Ritter ..... H01R 13/514 439/247
8,801,460 B2 * 8/2014 Van Swearingen ..... H01Q 1/00 439/578
8,894,431 B2 * 11/2014 Tiberghien ..... F16L 37/56 439/247
2005/0239310 A1 * 10/2005 Baker ..... H01R 13/6315 439/247
2008/0026622 A1 * 1/2008 Tomizu ..... H01R 13/6315 439/247
2014/0206221 A1 7/2014 Morley
2015/0380840 A1 * 12/2015 Chiang ..... H01R 9/0506 439/579

OTHER PUBLICATIONS

International Search Report, International Application No. PCT/US2016/065829, International Filing Date, dated Dec. 9, 2016.

* cited by examiner

COAXIAL CONNECTOR ASSEMBLY AND COMMUNICATION SYSTEM HAVING A PLURALITY OF COAXIAL CONTACTS

BACKGROUND

The subject matter described and/or illustrated herein relates generally to coaxial connector assemblies that are mounted to support walls, such as those found in backplane communication systems.

Coaxial connectors are known for interconnecting various coaxial components, such as coaxial cables, circuit boards, and/or the like. Coaxial connectors include one or more coaxial contact pairs. Each coaxial contact pair includes a signal element and a ground element that is arranged coaxially with the signal element. A coaxial contact pair is hereinafter referred to as a coaxial contact. Each coaxial contact may have a cable terminated thereto. Coaxial connectors often include an array of coaxial contacts. The coaxial connectors may be used for a wide variety of applications, such as, but not limited to, radio frequency (RF) interconnections. As one example, a backplane communication system may include a large backplane circuit board that includes one or more windows. Each window is configured to receive a coaxial connector that is also mounted to the backplane circuit board using, for example, hardware. As such, the coaxial connectors are presented along one side of the circuit board for mating with corresponding coaxial connectors of a daughter card assembly or assemblies.

Known coaxial connectors are not without disadvantages. For example, it may be desirable to have coaxial connectors that have a greater density of coaxial contacts. Even with greater densities, however, it may be difficult to mate the opposing coaxial connectors. For example, the coaxial contacts of one coaxial connector include signal pins that are exposed within socket cavities of the coaxial contacts. The signal pins are at risk of being damaged if the coaxial connectors are not sufficiently aligned during the mating operation.

Accordingly, there is a need for a coaxial connector having a greater density of coaxial contacts that also enables alignment of the coaxial contacts during the mating operation.

BRIEF DESCRIPTION

In an embodiment, a coaxial connector assembly is provided that includes a connector module having a connector body that includes a front side and a plurality of coaxial contacts that are coupled to the connector body and presented along the front side for engaging corresponding mating contacts of a mating connector. The front side faces in a mating direction along a mating axis. The coaxial connector assembly also includes a mounting frame having a mating side and a mounting side that face in opposite directions. The mounting side faces in a mounting direction along the mating axis and is configured to interface with a support wall. The mounting frame defines a passage that extends through the mating and mounting sides. The passage includes a connector-receiving recess that opens to the mounting side and is defined by blocking surfaces. The blocking surfaces include a first blocking surface that faces in a lateral direction that is perpendicular to the mating axis and a second blocking surface that faces in the mounting direction. The first and second blocking surfaces are sized and shaped relative to the connector module to permit the connector module to float relative to the mounting frame within a confined space that is defined by the first and second blocking surfaces.

In an embodiment, a coaxial connector assembly is provided that includes a coaxial connector having a connector body that includes a front side and a plurality of coaxial contacts that are coupled to the connector body and presented along the front side for engaging corresponding mating contacts of a mating connector. The front side faces in a mating direction along a mating axis. The connector body includes a rear section and a forward section that are discrete elements secured to each other. The rear and forward sections include contact cavities that align with each other to form corresponding channels in which each corresponding contact channel receives one of the coaxial contacts. The contact cavities of the rear section are defined by base surfaces that face in the mating direction. The coaxial connector assembly includes biasing springs positioned within the contact cavities of the rear section. The biasing springs are compressed between corresponding base surfaces and the corresponding coaxial contacts.

In an embodiment, a communication system is provided that includes a support wall having first and second wall surfaces that face in opposite directions along a mating axis and a thickness of the support wall being therebetween. The support wall has a window that extends through the first and second wall surfaces. The system also includes a connector module having a connector body that includes a front side and a plurality of coaxial contacts that are coupled to the connector body and presented along the front side for engaging corresponding mating contacts of a mating connector. The front side faces in a mating direction along the mating axis. The system also includes a mounting frame having a mating side and a mounting side that face in opposite directions. The mounting side faces in a mounting direction along the mating axis and is configured to interface with the support wall. The mounting frame defines a passage that extends through the mating and mounting sides. The passage includes a connector-receiving recess that opens to the mounting side and is defined by blocking surfaces. The blocking surfaces include a first blocking surface that faces in the mounting direction and a second blocking surface that faces in a lateral direction that is perpendicular to the mating axis. The mounting frame is secured to the first wall surface of the support wall and the connector module is disposed within the window of the support wall and the passage of the mounting frame. The first and second blocking surfaces and the window are sized and shaped relative to the connector module to permit the connector module to float relative to the mounting frame and the support wall within a confined space. The confined space is defined by the first and second blocking surfaces and a portion of the first wall surface of the support wall.

DETAILED DESCRIPTION

Embodiments set forth herein include coaxial connector assemblies and communication systems that include such coaxial connector assemblies. The communication system may include, for example, a circuit board that is secured to the coaxial connector assembly. In some embodiments, the communication system is a backplane (or midplane) communication system. As used herein, the terms backplane and midplane are used interchangeably and represent a system interface for multiple daughter card assemblies (e.g., line cards or switch cards). In other embodiments, the communication system is a circuit board assembly (e.g., daughter card assembly). One or more embodiments permit a connector module of the connector assembly to float during a mating operation. One or more embodiments enable using a denser grouping of coaxial contacts by permitting the coaxial contacts to be rear-loaded into the connector module. In particular embodiments, the connector module is permitted to float and also enables rear-loading of coaxial contacts.

As used herein, phrases such as "a plurality of [elements]," "a set of [elements]," "an array of [elements]," and the like, when used in the detailed description and claims, do not necessarily include each and every element that a component may have. For instance, the phrase "the connector module having a plurality of coaxial contacts that include [a recited feature]" does not necessarily mean that each and every coaxial contact of the connector module has the recited feature. Instead, only some of the coaxial contacts may have the recited feature and other coaxial contacts of the connector module may not include the recited feature. As another example, the detailed description or the claims may recite that a connector assembly includes "a cable assemblies, each of which including a [recited feature]." This phrase does not exclude the possibility that other cable assemblies of the connector assembly may not have the recited feature. Accordingly, unless explicitly stated otherwise (e.g., "each and every cable assembly of the connector module"), embodiments may include similar elements that do not have the same features.

Figure 1:
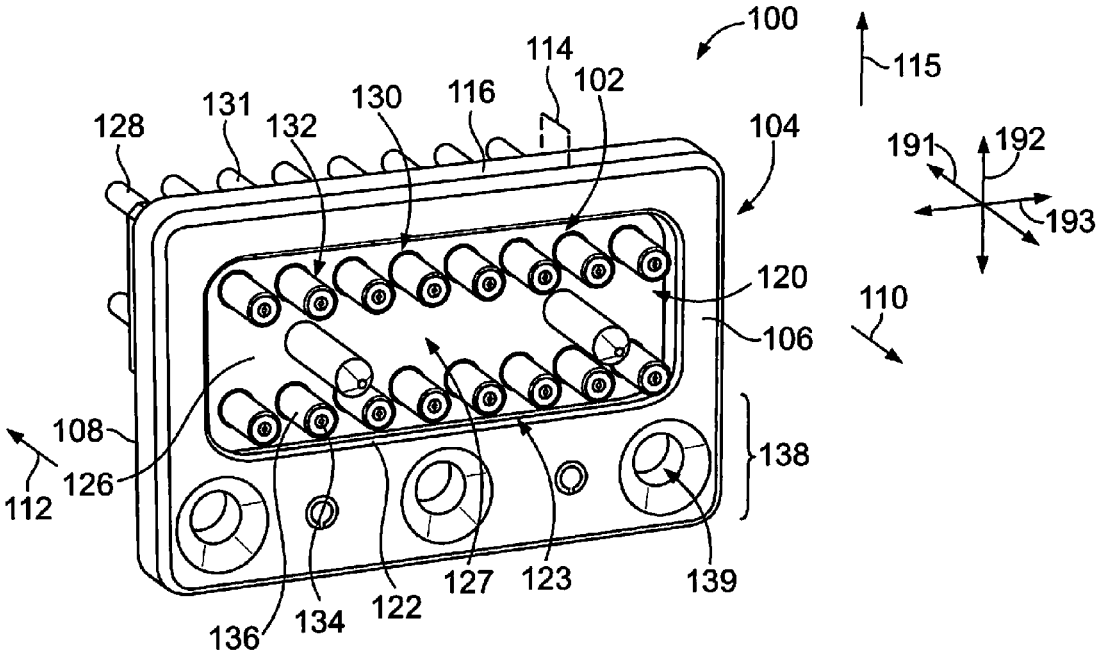
FIG. 1 is an isolated front perspective view of a coaxial connector assembly formed in accordance with an embodiment.
Figure 2:
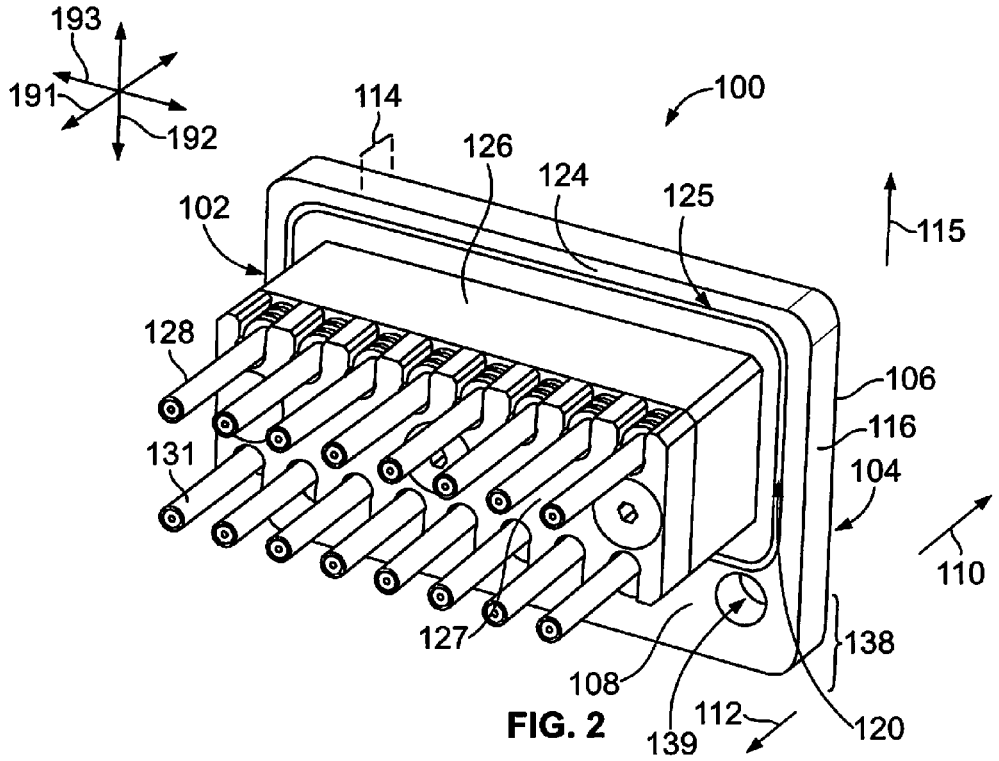
FIG. 2 is an isolated rear perspective view of the coaxial connector assembly of FIG. 1.

FIG. 1 is a front perspective view of an isolated coaxial connector assembly 100, and FIG. 2 is a rear perspective view of the coaxial connector assembly 100. In an exemplary embodiment, the coaxial connector assembly 100 is configured to mate with a coaxial connector assembly 306 (shown in FIG. 4) during a mating operation. The coaxial connector assembly 306 is hereinafter referred to as the mating connector. However, it should be understood that the coaxial connector assembly 100 may be configured to mate with alternative types of coaxial connectors in other embodiments.

For reference, the coaxial connector assembly 100 is oriented with respect to mutually perpendicular axes 191-193, which includes a mating axis 191, a first lateral axis 192, and a second lateral axis 193. The first and second lateral axes 192, 193 may define a lateral plane. As used herein, if an element moves "laterally" or in a "lateral direction," the movement may be in any direction along the lateral plane. For example, the movement may be parallel to the first lateral axis 192, parallel to the second lateral axis 193, or in a direction with a component along the first lateral axis 192 and a component along the second lateral axis 193. Although the first lateral axis 192 appears oriented parallel to gravity in FIGS. 1 and 2, the coaxial connector assembly 100 may have any orientation with respect to gravity. For simplicity, the coaxial connector assembly 100 is hereinafter referred to as the connector assembly 100.

Figure 5:
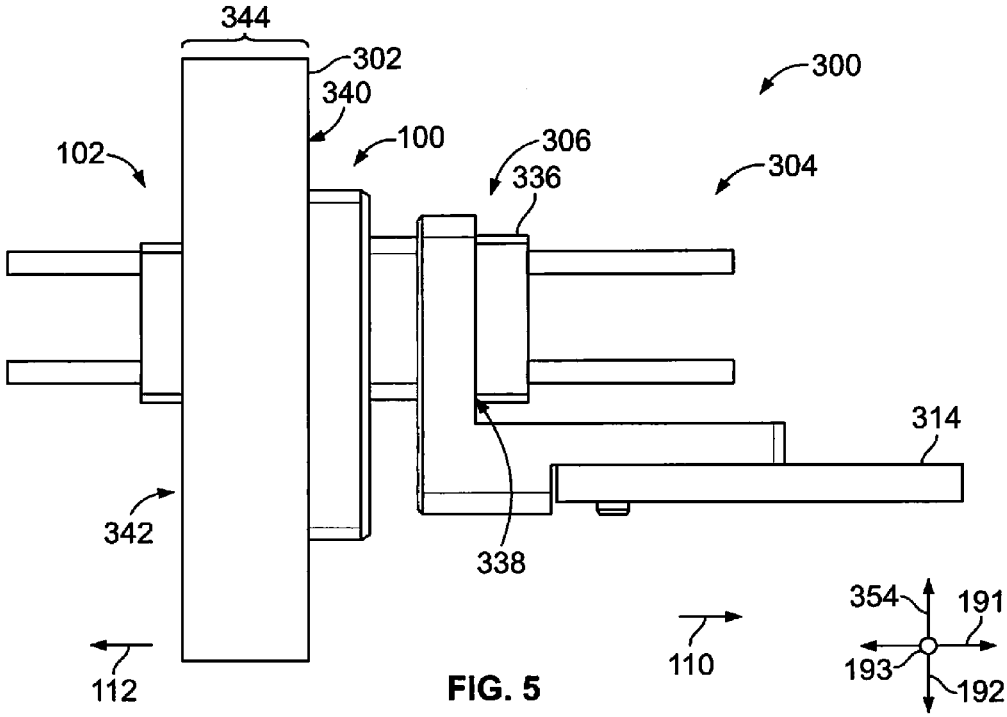
FIG. 5 is a side view of a portion of a communication system that includes the coaxial connector assembly of FIG. 1 and a daughter card assembly. The daughter card assembly includes the coaxial connector assembly of FIG. 4.

The connector assembly 100 includes a connector module (or coaxial connector) 102 and a mounting frame 104 that are operably coupled to each other. During operation or usage of the connector assembly 100, a portion of the connector module 102 is floatably held between the mounting frame 104 and a support wall 302 (FIG. 5). The support wall 302 may be, for example, a circuit board, panel, or other type of wall. As such, the connector module 102 is permitted to move in a lateral direction 115 during a mating operation. In FIGS. 1 and 2, the lateral direction 115 is shown as being parallel to the first lateral axis 192. It should be understood, however, that the lateral direction 115 may be any direction that is perpendicular to the mating axis 191 or parallel to a plane defined by the first and second lateral axes 191, 192.

The mounting frame 104 includes opposite mating and mounting sides 106, 108. More specifically, the mating side 106 is configured to face in a mating direction 110 along the mating axis 191, and the mounting side 108 is configured to face in a mounting direction 112 along the mating axis 191 that is opposite the mating direction 110. The mounting frame 104 has a thickness 114 that is defined between the mating and mounting sides 106, 108. The mounting frame 104 has an outer frame edge or wall 116 that defines an outer perimeter or border of the mounting fame 104. In the illustrated embodiment, the mounting frame 104 has a substantially rectangular profile that is defined by the outer frame edge 116, but the mounting frame 104 may have profiles with other shapes in alternative embodiments.

Also shown, the mounting frame 104 includes a passage 120 that extends through the mating and mounting sides 106, 108. The passage 120 is sized and shaped to receive a portion of the connector module 102. For example, the mounting frame 104 includes a front edge 122 (FIG. 1) along the mating side 106, and a back edge 124 (FIG. 2) along the mounting side 108. The front edge 122 defines a front opening 123 (FIG. 1) to the passage 120, and the back edge 124 defines a back opening 125 (FIG. 2) to the passage 120. The passage 120 extends between the front and back openings 123, 125.

The front and back edges 122, 124 have different dimensions in order to position and hold the connector module 102 as described herein. More specifically, the front and back edges 122, 124 are dimensioned to form blocking surfaces (described below) that engage the connector module 102 and prevent the connector module 102 from passing freely through the passage 120. The blocking surfaces may also prevent the connector module 102 from moving laterally beyond a confined space 204 (shown in FIG. 6). The back edge 124 is dimensioned to allow the passage 120 to receive a portion of the connector module 102 as the mounting frame 104 is moved in the mounting direction 112.

The connector module 102 includes a connector body 126 having a front side 127 (FIG. 1) and a rear side 129 (FIG. 2) that face in the mating direction 110 and the mounting direction 112, respectively. The connector module 102 also includes a contact array 130 (FIG. 1) of coaxial contacts 132 (FIG. 1) that are coupled to the connector body 126. In particular embodiments, a pitch (or center-to-center spacing) between adjacent coaxial contacts 132 may be between 1.50 mm and 5.00 mm. In particular embodiments, the pitch may be between 2.00 mm and 3.50 mm or, more particularly, between 2.50 and 2.9. In other embodiments, however, the pitch may be greater or smaller.

Figure 4:
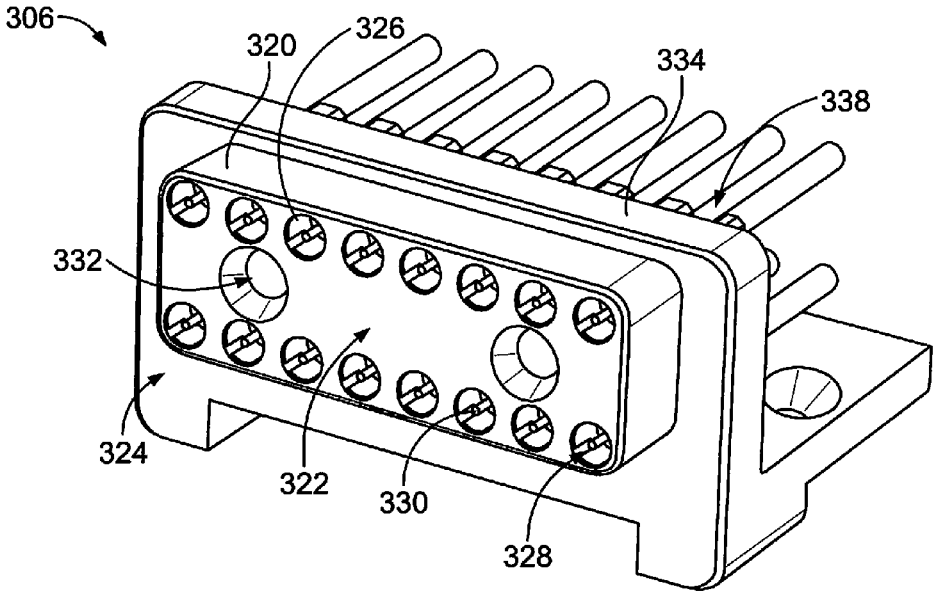
FIG. 4 is an isolated front perspective view of a mating coaxial connector assembly that is configured to engage the coaxial connector assembly of FIG. 1 during a mating operation.

The connector body 126 holds the coaxial contacts 132 at designated positions for engaging corresponding coaxial contacts 326 (shown in FIG. 4). In the illustrated embodiment, the coaxial contacts 132 are elements of corresponding coaxial cable assemblies 128. The coaxial contacts 132 represent terminating ends of the corresponding coaxial cable assemblies 128. Each of the coaxial contacts 132 includes a signal element 134 (FIG. 1) and a ground element 136 (FIG. 1) that is coaxially aligned with the signal element 134. The signal and ground elements 134, 136 may be electrically coupled to signal and ground paths (not shown) through cable segments 131 of the coaxial cable assemblies 128. In alternative embodiments, the coaxial contacts 132 are not elements of coaxial cables and may be configured for termination to other components, such as a circuit board.

In an exemplary embodiment, the connector assembly 100 is configured to engage a daughter card assembly 304 (FIG. 5) to form a backplane communication system 300 (FIG. 5). In some applications, the daughter card assembly 304 may be referred to more generally as a circuit board assembly or a communication system. The communication system 300 may be configured for radiofrequency (RF) applications. In particular embodiments, the communication system 300 and/or its components, such as the connector assembly 100, are configured to satisfy military and aerospace applications. For example, the components of the communication system 300 may be configured to satisfy one or more industry or government standards, such as MIL-STD-348. To illustrate one example of the communication system 300, the connector assembly 100 and the daughter card assembly 304 may form an interconnect between analog and digital sections of a radio. The daughter card assembly 304 may perform analog functions. The daughter card assembly 304 may be replaced with other daughter card assemblies that are configured to perform the same or different operations. The digital functions, including digital signal processing, may be performed by a communication component (not shown) that is coupled to the connector assembly 100. The other communication component may be another daughter card assembly (not shown).

The communication system 300 and/or its components (e.g., the connector assembly 100) may be configured to satisfy one or more industry or government standards. By way of example only, embodiments may be configured to satisfy the VME International Trade Association (VITA) standards (e.g., VITA 48, VITA 67, et al.). The communication system 300 and/or its components may have an operating speed that achieves 50 GHz or greater. In particular embodiments, the communication system 300 and/or its components may achieve an operating speed of 60 GHz or greater. It should be understood, however, that other embodiments may be configured for different standards and may be configured to operate at different speeds. In some configurations, embodiments may be configured to operate within the range of DC to 60.0 GHz.

Figure 6:
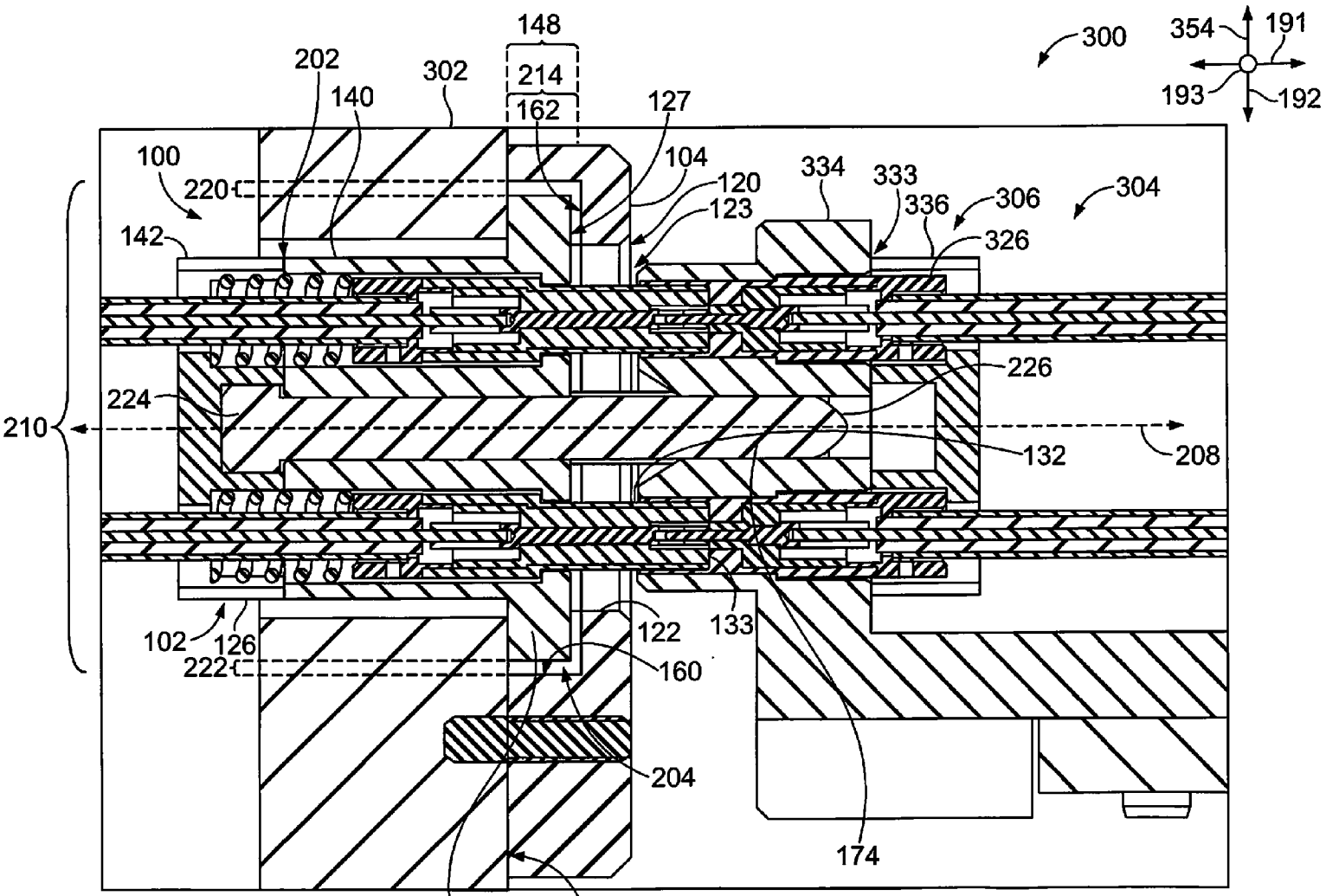
FIG. 6 is a side cross-section of the communication system of FIG. 5 illustrating the coaxial connector assemblies of FIGS. 1 and 4 mated or engaged with each other.

Also shown in FIGS. 1 and 2, the mounting frame 104 may include a frame extension 138. The frame extension 138 represents a section of the mounting frame 104 that extends laterally away from the passage 120. The frame extension 138 is configured to interface with the support wall 302 (FIG. 5). The frame extension 138 includes one or more thru-holes 139 that are sized and shaped to receive hardware (e.g., screws, bolts, plugs, and the like) for securing the mounting frame 104 to the support wall 302. In some embodiments, the thru-holes 139 may be defined by threaded surfaces of the mounting frame 104 for engaging screws. In other embodiments, the surfaces that define the thru-holes 139 are not threaded. The mounting frame 104 is configured to have a fixed position relative to the support wall 302. The connector module 102, on the other hand, is permitted to float relative to the support wall 302 within a confined space 204 (FIG. 6).

Figure 3:
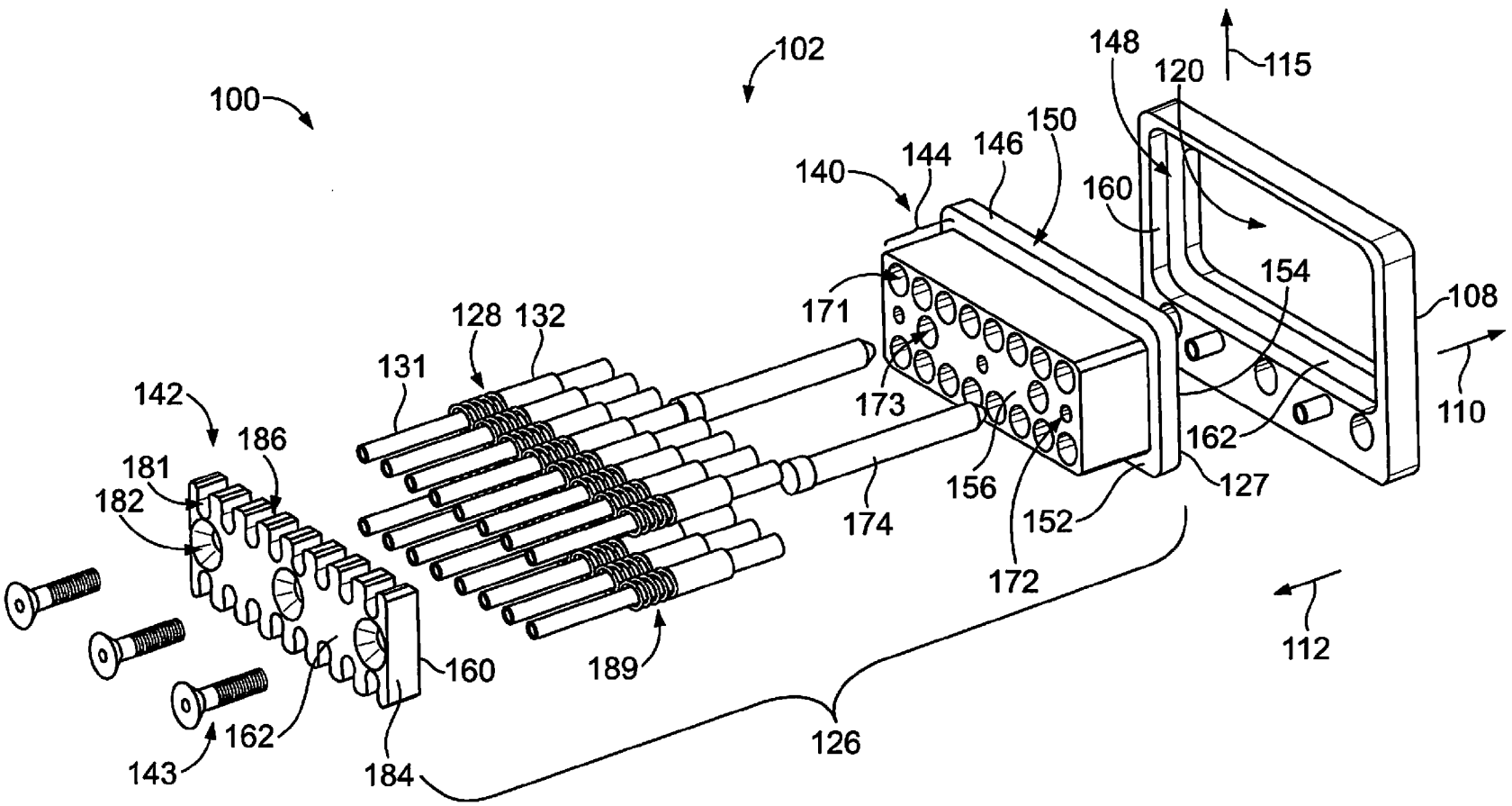
FIG. 3 is an exploded view of the coaxial connector assembly of FIG. 1.

FIG. 3 is an exploded view of the connector assembly 100. The connector body 126 includes a forward section 140 and a rear section 142. The forward and rear sections 140, 142 are discrete elements that are configured to be secured to each other. In the illustrated embodiment, the forward and rear sections 140, 142 are secured to each other using hardware 143 (e.g., screws), but may be secured to each other in other manners in alternative embodiments. The forward section 140 includes a main portion 144 and a flange portion 146 that extends laterally (or radially) away from the main portion 144. The flange portion 146 includes a flange edge 150, the front side 127 of the connector body 126, and a rearward-facing surface 152. The rearward-facing surface 152 faces in the mounting direction 112. The flange edge 150 faces radially away from the connector body 126. The front side 127 faces in the mating direction 110.

The mounting frame 140 includes a connector-receiving recess 148 of the passage 120 that opens along the mounting side 108. The connector-receiving recess 148 is sized and shaped to receive the flange portion 146 of the connector body 126. The connector-receiving recess 148 is defined by first and second blocking surfaces 160, 162. The first blocking surface 160 faces in the lateral direction 115 that is perpendicular to the mating axis 191, and the second blocking surface 162 faces in the mounting direction 112. The first and second blocking surfaces 160, 162 are sized and shaped relative to the connector module 102 or, more specifically, relative to the flange portion 146. The first and second blocking surfaces 160, 162 are configured to engage the connector module 102 and permit the connector module 102 to float relative to the mounting frame 104. In the illustrated embodiment, the first blocking surface 160 is configured to engage the flange edge 150, and the second blocking surface 162 is configured to engage a designated area 154 of the front side 127. The designated area 154 extends along the flange edge 150. In particular embodiments, the first and second blocking surfaces 160, 162 permit the connector module 102 to float at least 0.15 mm along a lateral plane 354 (shown in FIG. 5). In particular embodiments, the connector module 102 may be permitted to float at least 0.25 mm or, more particularly, at least 0.35 mm along the lateral plane 354. It should be understood, however, that the connector assembly 100 may be configured to permit a greater or lesser amount of floating than the values provided above.

The flange portion 146 is configured to be retained or trapped between the support wall 302 (FIG. 5) and the mounting frame 104. In the illustrated embodiment, the flange portion 146 extends entirely around the main portion 144 in a substantially even manner. In other embodiments, however, the flange portion 146 may include a plurality of separate elements that extend laterally away from the main portion 144. Such elements may also be trapped between the support wall 302 and the mounting frame 104. In other embodiments, the flange portion 146 extends only partially around the main portion 144 or is located along only one side or two opposite sides of the main portion 144. Accordingly, the flange portion 146 may have various configurations that enable retaining the flange portion 146 between the support wall 302 and the mounting frame 104.

The forward section 140 of the connector body 126 has a loading side 156 that faces in the mounting direction 112. The loading side 156 is opposite the front side 127. The rear section 142 includes a section side 164 that faces in the mating direction 110, and a loading side 166 that faces in the mounting direction 112. The loading side 156 of the forward section 140 and the section side 164 of the rear section 142 are configured to engage each other along an interface 202 (shown in FIG. 6).

The forward section 140 includes a plurality of contact cavities 171, and the rear section 142 includes a plurality of contact cavities 181. When the forward and rear sections 140, 142 are coupled to each other, the contact cavities 171 of the forward section 140 and the contact cavities 181 of the rear section 142 align with each other to form contact channels 230 (shown in FIG. 6). Each of the contact channels 230 is configured to receive a portion of a corresponding coaxial cable assembly 128 and, in particular, a corresponding coaxial contact 132.

The rear section 142 also includes an outer section edge 184 that faces radially or laterally away from the rear section 142. The contact cavities 181 extend through the section side 164 and the loading side 166. In some embodiments, as shown in FIG. 3, the contact cavities 181 may open to the outer section edge 184. More specifically, the outer section edge 184 may include open-sided slots 186 that provide access to the contact cavities 181. The open-sided slots 186 are sized and shaped to receive the cable segments 131 of the coaxial cable assemblies 128.

In some embodiments, the forward section 140 may also include a plurality of coupling cavities 172, and the rear section 142 may also include a plurality of coupling cavities 182. When the forward and rear sections 140, 142 are coupled to each other, the coupling cavities 172 of the forward section 140 and the coupling cavities 182 of the rear section 142 align with each other to form coupling channels (not shown as a whole). The coupling channels are configured to receive corresponding hardware 143 for securing the forward and rear sections 140, 142 to each other.

In the illustrated embodiment, the forward section 140 also includes alignment channels 173 that extend entirely through the forward section 140. The alignment channels 173 are configured to receive alignment posts 174 that are configured to clear the front side 127 and the passage 120 and project away from the mounting frame 104 in the mating direction 110. The alignment posts 174 are configured to engage the mating connector 306 (FIG. 4) during the mating operation. In the illustrated embodiment, the connector assembly 100 includes two alignment posts 174. In other embodiments, however, the connector assembly 100 may include only one alignment post 174 or more than two alignment posts 174.

The connector assembly 100 may also include a plurality of the cable assemblies 128. The biasing spring 189 is configured to have a cable segment 131 of the corresponding coaxial cable assembly 128 extend therethrough. As shown in FIG. 3, the biasing spring 189 is positioned adjacent to a back end 194 of the coaxial contact 132 of the corresponding coaxial cable assembly 128.

To construct the connector module 102, the cable segments 131 may be inserted into the contact cavities 181 of the rear section 142 and the coaxial cable assemblies 128 may be pulled in the mounting direction 112 until, for example, the biasing springs 189 engage the rear section 142. The alignment posts 174 may be inserted through the alignment channels 173 of the forward section 140. The forward and rear sections 140, 142 may then be coupled to each other. As the forward and rear sections 140, 142 are coupled, the coaxial contacts 132 may be received within corresponding contact cavities 171 of the forward section 140. The coaxial contacts 132 may engage interior surfaces of the forward section 140 that block the coaxial contacts 132 from moving further forward in the mating direction 110. The biasing springs 189 may compress between the corresponding coaxial contacts 132 and the rear section 142 as the rear section 142 continues to move toward the forward section 140. When the section side 164 and the loading side 156 engage each other, the hardware 143 may be used to secure the forward and rear sections 140, 142 to each other.

Embodiments set forth herein may also enable replacing individual coaxial contacts of a connector module. For example, after assembly or usage of the connector assembly 100, the mounting frame 104 may be demounted and the connector module 102 may be removed. The forward and rear sections 140, 142 may be separated to allow access to the coaxial contacts 132. One or more of the coaxial contacts 132 may be replaced or repositioned. The connector module 102 may then be re-assembled and the connector assembly 100 may be secured to the support wall 302.

FIG. 4 is an isolated front perspective view of the mating connector 306. In an exemplary embodiment, the mating connector 306 is configured to be coupled to a daughter card 314 (FIG. 5) to form a daughter card assembly 304 (FIG. 5). In other embodiments, however, the mating connector 306 may not be part of a daughter card assembly. The mating connector 306 includes a connector body 320 having a front side 322 and a two-dimensional contact array 324 of coaxial contacts 326. The coaxial contacts 326 have receiving cavities 328 that are sized and shaped to receive portions of corresponding coaxial contacts 132 (FIG. 1). The coaxial contacts 326 include signal pins 330 disposed in the receiving cavities 328 that are configured to engage the signal elements 134 (FIG. 1) of the corresponding coaxial contacts 132. Also shown, the front side 322 includes alignment cavities 332. The alignment cavities 332 are configured to receive corresponding alignment posts 174 (FIG. 3). The alignment cavities 332 are defined by interior surfaces that engage the corresponding alignment posts 174 during the mating operation. The alignment cavities 332 may be equal to the number of alignment posts 174. As described above, one or more alignment posts 174 may be used.

In the illustrated embodiment, the connector body 320 is constructed in a similar manner as the connector body 126 (FIG. 1). For instance, the connector body 320 includes discrete forward and rear sections 334, 336 (shown in FIG. 5) that couple to each other along an interface 338 (shown in FIG. 6). The rear section 336 may include contact cavities 338 that are similar to the contact cavities 181 (FIG. 3). Similar to the forward and rear sections 140, 142 (FIG. 3), the forward and rear sections 334, 336 are configured to hold the coaxial contacts 326. In the illustrated embodiment, the mating connector 306 does not include biasing springs (not shown) for providing spring-loaded coaxial contacts. Optionally, however, biasing springs may be used with the coaxial contacts 326. The biasing springs may be similar to, for example, the biasing springs 189. In alternative embodiments, however, the connector body 320 is constructed in other manners.

FIG. 5 is a side view of the communication system 300. In the illustrated embodiment, the communication system 300 includes the connector assembly 100 and the support wall 302. Optionally, the communication system 300 may include the daughter card assembly 304 having the mating connector 306. The daughter card assembly 304 (or the mating connector 306) is mated with the connector assembly 100 in FIG. 5. As shown, the daughter card 314 of the daughter card assembly 304 is oriented orthogonal or perpendicular to the support wall 302. The daughter card assembly 304 also includes cable assemblies 350 that each include a cable segment 352 and a coaxial contact 328 (FIG. 5). In alternative embodiments, the daughter card assembly 304 does not include cables that directly couple to the coaxial contacts 326. For example, the coaxial contacts 326 may directly engage the daughter card 314 and be communicatively coupled to cables through traces and vias (not shown) of the daughter card 314.

The support wall 302 includes first and second wall surfaces or sides 340, 342 that face in opposite directions along the mating axis 191. More specifically, the first wall surface 340 faces in the mating direction 110 and the second wall surface 342 faces in the mounting direction 112. A thickness 344 of the support wall 302 is defined between the first and second wall surfaces 340, 342. A window 345 through the first and second wall surfaces 340, 342 and is configured to receive the connector module 102. As shown in FIG. 5, the mounting frame 104 is disposed along the first wall surface 340. A portion of the connector module 102, in an exemplary embodiment, may clear the second wall surface 342. The connector module 102 is permitted to float in any direction along a lateral plane 354 defined by the first and second lateral axes 192, 193.

FIG. 6 is a cross-section of the communication system 300 after the connector assembly 100 and the daughter card assembly 304 have mated each other and are in an operating state such that data signals may be transmitted therebetween. As shown, the forward and rear sections 140, 142 of the connector module 102 engage each other along an interface 202. Likewise, the forward and rear sections 334, 336 of the mating connector 306 engage each other along an interface 333.

As described herein, the mounting frame 104 and the support wall 302 define a confined space 204. In some embodiments, the confined space 204 may represent only a portion of the connector-receiving recess 148 less the volume occupied by the connector module 102. In particular, the confined space 204 is define by the first wall surface 340, the first blocking surface 160, and the second blocking surface 162. In the illustrated embodiment, a central axis 208 that extends parallel to the mating axis 191 also extends through a geometric center of the passage 120. The first blocking surface 160 extends entirely around the central axis 208 such that the first blocking surface 160 surrounds the connector module 102. The first blocking surface 160 may face substantially radially-inward. The lateral plane 354 is perpendicular to the central axis 208.

It should be understood that the first blocking surface 160 may include multiple surfaces that face in a direction along the lateral plane 354. For example, the first blocking surface 160 may be shaped to extend continuously around the central axis 208 and have curved corners. Alternatively, the first blocking surface 160 may include a first planar surface that extends parallel to the first lateral axis 192 and a second planar surface that extends parallel to the second lateral axis 193. The first and second planar surfaces may couple to each other at a corner. Likewise, it should be understood that the second blocking surface may include one continuous surface or multiple surfaces that face in the mounting direction 112. The second blocking surface 162 couples to the front edge 122 that defines the front opening 123.

Accordingly, the connector-receiving recess 148 may have a first dimension 210 that is measured between opposing surfaces of the first blocking surface 160. The first dimension 210 may be measured parallel to the first lateral axis 192. The connector-receiving recess 148 may also have a second dimension (not shown) that is measured between opposing surfaces of the first blocking surface 160 and parallel to the second lateral axis 193. The connector-receiving recess 148 may also have a third dimension 214 that is measured between the first wall surface 340 and the second blocking surface 162. The third dimension 214 may be measured parallel to the mating axis 191 or the central axis 208.

In some embodiments, the portion of the connector module 102 that is disposed within the connector-receiving recess 148 is sized and shaped to provide a confined or floating space 204 within the connector-receiving recess 148. The confined space 204 represents the space in which the portion of the connector module 102 is permitted to move relative to the support wall 302 or the mounting frame 104. For example, the flange portion 146 is disposed within the connector-receiving recess 148 in FIG. 6. The flange portion 146 is centrally located such that the flange portion 146 may float in any direction along the lateral plane 354. For instance, the flange portion 146 is permitted to move a shift distance 220 along the first lateral axis 192 or, in an opposite direction, a shift distance 222 along the first lateral axis 192. The flange portion 146 may also be permitted to move shift distances in either direction along the second lateral axis 193.

During lifetime operation of the connector assembly 100, however, the connector assembly 100 may have a different position within the connector-receiving recess 148 prior to mating with the mating connector 306 than the position shown in FIG. 6. For example, gravity may cause the flange portion 146 to engage or be located closer to one area of the first blocking surface 160 than other areas. As such, the shift distances may vary depending upon the dimensions of the first blocking surface 160, the flange portion 146, gravity, and/or other factors.

In some embodiments, the third dimension 214 is sized to allow the flange portion 146 and, consequently, the connector module 102 to rotate. For example, the connector module 102 may be permitted to roll about the central axis 208, pitch with respect to an axis that extends parallel to the second lateral axis 193, or yaw with respect to the first lateral axis 192. Such embodiments may facilitate aligning and mating corresponding coaxial contacts without stubbing or other damage to the connector assemblies.

As shown, the alignment post 174 extends from a base end 224 to a distal end 226. More specifically, the alignment post 174 extends through the connector body 126, away from the front side 127, and clears leading ends 133 of the coaxial contacts 132 such that the distal end 226 is positioned in front of the coaxial contacts 132. The distal end 226 is configured to engage the mating connector 306 prior to the mating connector 306 engaging the coaxial contacts 132. As such, the mating connector 306 may be grossly or approximately aligned prior to the coaxial contacts 132 engaging the coaxial contacts 326. In alternative embodiments, the connector assembly 100 does not include alignment posts, but include alignment cavities that are configured to receive alignment posts. Yet in other embodiments, the connector assembly 100 is devoid of alignment posts and alignment cavities.

After the alignment post(s) 174 engage the mating connector 306, the coaxial contacts 132 and 326 engage one another other. The mating of coaxial contacts 132, 326 is configured to occur at a predetermined sequence such that the ground elements engage each other first prior to the signal elements engaging each other. During the mating operation, forces applied by the mating connector 306 may cause the connector module 102 to float and/or rotate. For example, the forces applied by the mating connector 306 when engaging the alignment post 174, the front side 127, and/or the coaxial contacts 132 may cause the connector module 102 to move along the lateral plane. Such movement is limited by the first blocking surface 160. Alternatively or in addition this, the forces applied by the mating connector 306 when engaging the alignment post 174, the front side 127, and/or the coaxial contacts 132 may cause the connector module 102 to rotate (e.g., roll, pitch, and/or yaw). Such movement may be limited by the first blocking surface 160, the second blocking surface 162, and the first wall surface 340.

Figure 7:
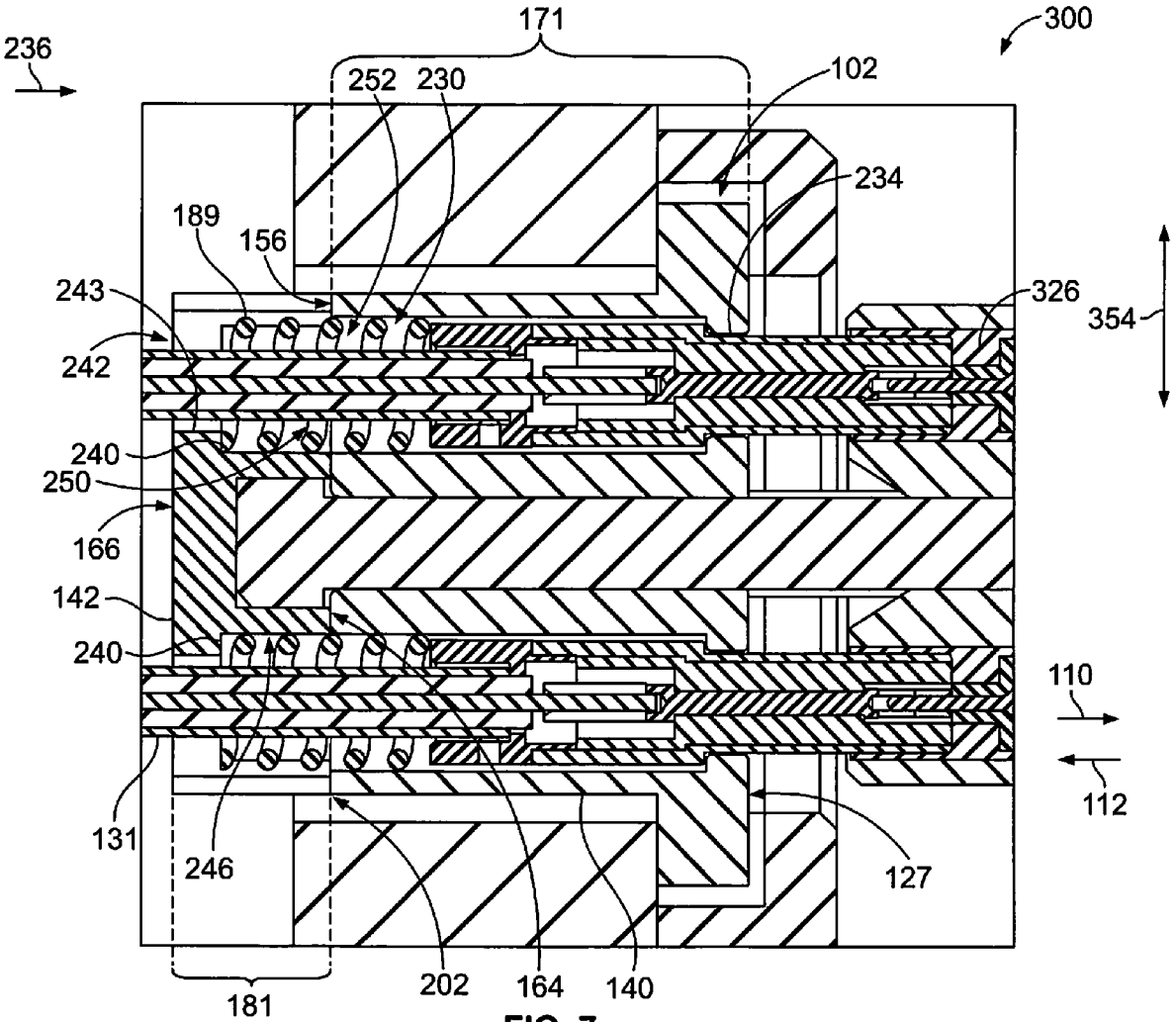
FIG. 7 is an enlarged side cross-section of the communication system of FIG. 5.

FIG. 7 is an enlarged view of the cross-section of the communication system 300. As shown, the biasing springs 189 are disposed within the contact channels 230. The contact channels 230 are formed by the contact cavities 171 of the forward section 140 and the contact cavities 181 of the rear section 142. The contact cavities 181 of the rear section 142 are defined by an interior base surfaces 240 that face in the mating direction 110. The base surface 240 is dimensioned such that a cable opening 242 along the loading side 166 permits the cable segment 131 to extend therethrough but prevents the biasing spring 189 from inadvertently moving through the cable opening 242.

The cable opening 242 is defined by an opening edge 243. The base surface 240 extends between the opening edge 243 and a cavity surface 246 of the rear section 142. The cavity surface 246 defines the contact cavity 181. The section side 164 of the rear section 142 and the loading side 156 of the forward section 140 have respective cable openings 250, 252 that align with one another. The cable openings 250, 252 are sized larger than the cable opening 242 along the lateral plane 354 and permit the biasing spring 189 to extend therethrough. As such, the biasing spring 189 engages the base surface 240 at one end and a corresponding coaxial contact 132 at an opposite end.

In the illustrated embodiment, the biasing springs 189 are disposed within the contact cavities 171 and the contact cavities 181. When the connector module 102 is assembled, the coaxial contacts 132 are inserted into the contact cavities 171 through the loading side 156. The coaxial contacts 132 engage rim edges 234 along or proximate to the front side 127 that block the coaxial contacts 132 from moving entirely through the forward section 140. As the rear section 142 is moved toward the forward section 140, the biasing springs 189 may be compressed. When the rear section 142 and the forward section 140 engage each other along the interface 202, a stored potential energy provides a biasing force 236 in the mating direction 110.

Accordingly, when the connector module 102 is fully constructed, the biasing springs 189 may be compressed between corresponding base surfaces 240 and the corresponding coaxial contacts 132. The biasing force 236 of the biasing springs 189 is configured to hold the corresponding coaxial contact 132 in a forward position to assure that the corresponding coaxial contact 132 engages the corresponding coaxial contact 326 of the mating connector 306 to form a sufficient connection. For example, in some cases, the daughter card assembly or the mating connector may not be positioned properly after mating or may be incapable of being fully seated. In such instances, the biasing springs 189 increase the likelihood that the coaxial contacts 132, 326 will be sufficiently engaged. The biasing springs 189 may also permit the coaxial contacts 132 to be deflected or pushed in the mounting direction 112 during the mating operation if the coaxial contacts 132, 36 are initially misaligned. The biasing force 236 may facilitate maintaining a sufficient electrical connection between the coaxial contacts 132 and the coaxial contacts 326. For example, in some environments, the communication system 300 may experience shock, vibration, and/or extreme temperatures that may cause deformation, movement, and/or creepage among different elements. The biasing force 236 may lengthen or improve the lifetime operability of the communication system 300.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A coaxial connector assembly comprising:

a connector module having a connector body that includes a front side and a plurality of coaxial contacts that are coupled to the connector body and presented along the front side for engaging corresponding mating contacts of a mating connector, the front side facing in a mating direction along a mating axis;

a mounting frame having a mating side and a mounting side that face in opposite directions, the mounting side facing in a mounting direction along the mating axis and configured to interface with a support wall, the mounting frame defining a passage that extends through the mating and mounting sides, the passage including a connector-receiving recess that opens to the mounting side and is defined by blocking surfaces, the blocking surfaces including a first blocking surface that faces in a lateral direction that is perpendicular to the mating axis and a second blocking surface that faces in the mounting direction, the first and second blocking surfaces being sized and shaped relative to the connector module to permit the connector module to float relative to the mounting frame within a confined space that is defined by the first and second blocking surfaces.

2. The coaxial connector assembly of claim 1, wherein the connector body includes a rear section and a forward section that are discrete elements, the forward section sized and shaped to be positioned within the connector-receiving recess, the rear and forward sections include respective contact cavities that align with each other to form corresponding contact channels in which each corresponding contact channel receives a coaxial contact, wherein the contact cavities of the rear section are defined by base surfaces that face in the mating direction, the coaxial connector assembly including biasing springs positioned within the contact cavities of the rear section, the biasing springs being compressed between the corresponding base surfaces and the corresponding coaxial contacts.

3. The coaxial connector assembly of claim 1, wherein a central axis that is parallel to the mating axis extends through a center of the passage, the first blocking surface surrounding the central axis.

4. The coaxial connector assembly of claim 1, wherein the connector module includes a main portion and a flange portion that extends laterally away from the main portion, the flange portion configured to engage the first and second blocking surfaces.

5. The coaxial connector assembly of claim 1, wherein the coaxial contacts are spring-loaded such that the coaxial contacts are permitted to move in the mounting direction.

6. The coaxial connector assembly of claim 1, wherein the first and second blocking surfaces are sized and shaped to permit the connector module to rotate within the connector-receiving recess.

7. The coaxial connector assembly of claim 1, wherein a central axis that is parallel to the mating axis extends through a center of the passage, the first and second blocking surfaces permitting the connector module to float at least 0.15 mm along a lateral plane that is perpendicular to the central axis.

8. The coaxial connector assembly of claim 1, wherein the plurality of coaxial contacts form an array of coaxial contacts, wherein a pitch of the array of coaxial contacts is between 1.50 mm and 5.00 mm.

9. A coaxial connector assembly comprising:

a coaxial connector having a connector body that includes a front side and a plurality of coaxial contacts that are coupled to the connector body and presented along the front side for engaging corresponding mating contacts of a mating connector, the front side facing in a mating direction along a mating axis;

wherein the connector body includes a rear section and a forward section that are discrete elements secured to each other, the rear section including a section side that faces in the mating direction, each of the rear and forward sections including a plurality of contact cavities, the contact cavities of the rear and forward sections aligning with one another to form corresponding channels in which each corresponding contact channel receives one of the coaxial contacts, wherein the contact cavities of the rear section extend through the section side and are defined by base surfaces that face in the mating direction, the coaxial connector assembly including biasing springs positioned within the contact cavities of the rear section, the biasing springs being compressed between corresponding base surfaces and the corresponding coaxial contacts.

10. The coaxial connector assembly of claim 9, wherein the biasing springs extend from within the contact cavities of the rear section and into the contact cavities of the forward section.

11. The coaxial connector assembly of claim 9, wherein the coaxial contacts form a two-dimensional array of coaxial contacts.

12. The coaxial connector assembly of claim 9, wherein the plurality of coaxial contacts form an array of coaxial contacts, wherein a pitch of the array of coaxial contacts is between 1.50 mm and 5.00 mm.

13. The coaxial connector assembly of claim 9, wherein the forward section has a loading side that faces in a mounting direction that is opposite the mating direction, the loading side of the forward section and the section side of the rear section engaging each other along an interface.

14. The coaxial connector assembly of claim 9, wherein the biasing springs directly engage the base surfaces.

15. A coaxial connector assembly comprising:

a coaxial connector having a connector body that includes a front side and a plurality of coaxial contacts that are coupled to the connector body and presented along the front side for engaging corresponding mating contacts of a mating connector, the front side facing in a mating direction along a mating axis;

wherein the connector body includes a rear section and a forward section that are discrete elements secured to each other, the rear and forward sections including contact cavities that align with each other to form corresponding channels in which each corresponding contact channel receives one of the coaxial contacts, wherein the contact cavities of the rear section are defined by base surfaces that face in the mating direction, the coaxial connector assembly including biasing springs positioned within the contact cavities of the rear section, the biasing springs being compressed between corresponding base surfaces and the corresponding coaxial contacts;

wherein the rear section includes a section side and a loading side and an outer section edge that extends therebetween, the outer section edge having open-sided slots that open to the outer section edge and provide access to the contact cavities of the rear section.

16. The coaxial connector assembly of claim 15, further comprising a plurality of cable assemblies in which each of the cable assemblies includes a corresponding coaxial contact of the plurality of coaxial contacts and a cable segment that couples to the corresponding coaxial contact, each of the open-sided slots being sized and shaped relative to a diameter of the cable segment to permit insertion of the cable segment into the corresponding open-sided slot.

17. The coaxial connector assembly of claim 15, wherein the rear section includes a section side and a loading side and an outer section edge that extends therebetween, the outer section edge having open-sided slots that open to the outer section edge and provide access to the contact cavities of the rear section.

18. A communication system comprising:

a support wall having first and second wall surfaces that face in opposite directions along a mating axis and a thickness of the support wall being therebetween, the support wall having a window that extends through the first and second wall surfaces;

a connector module having a connector body that includes a front side and a plurality of coaxial contacts that are coupled to the connector body and presented along the front side for engaging corresponding mating contacts of a mating connector, the front side facing in a mating direction along the mating axis;

a mounting frame having a mating side and a mounting side that face in opposite directions, the mounting side facing in a mounting direction along the mating axis and configured to interface with the support wall, the mounting frame defining a passage that extends through the mating and mounting sides, the passage including a connector-receiving recess that opens to the mounting side and is defined by blocking surfaces, the blocking surfaces including a first blocking surface that faces in the mounting direction and a second blocking surface that faces in a lateral direction that is perpendicular to the mating axis;

wherein the mounting frame is secured to the first wall surface of the support wall and the connector module is disposed within the window of the support wall and the passage of the mounting frame, the first and second blocking surfaces and the window being sized and shaped relative to the connector module to permit the connector module to float relative to the mounting frame and the support wall within a confined space that is defined by the first and second blocking surfaces and a portion of the first wall surface of the support wall.

19. The communication system of claim 18, wherein the connector module includes a main portion and a flange portion that extends laterally away from the main portion, the flange portion configured to engage the first and second blocking surfaces.

20. The communication system of claim 18, wherein the plurality of coaxial contacts form an array of coaxial contacts, wherein a pitch of the array of coaxial contacts is between 1.50 mm and 5.00 mm.

* * * * *